US009336707B2

(12) United States Patent
Song et al.

(10) Patent No.: US 9,336,707 B2
(45) Date of Patent: May 10, 2016

(54) GAMMA VOLTAGE SUPPLY DEVICE AND DISPLAY DEVICE USING THE SAME

(71) Applicant: SAMSUNG DISPLAY CO., LTD., Yongin, Gyeonggi-Do (KR)

(72) Inventors: Myoung-Seop Song, Yongin (KR); Jun-Yi Choi, Yongin (KR); Myung-Ho Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 78 days.

(21) Appl. No.: 14/261,933

(22) Filed: Apr. 25, 2014

(65) Prior Publication Data

US 2015/0015618 A1 Jan. 15, 2015

(30) Foreign Application Priority Data

Jul. 15, 2013 (KR) ..... 10-2013-0083016

(51) Int. Cl.
*G09G 3/36* (2006.01)
*G09G 3/32* (2016.01)

(52) U.S. Cl.
CPC ..... *G09G 3/3208* (2013.01); *G09G 2320/0276* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 9,224,332 | B2 * | 12/2015 | Byun et al. | G09G 3/3233 |
| 2009/0160880 | A1 * | 6/2009 | Park | G09G 3/3233 345/690 |
| 2010/0123653 | A1 * | 5/2010 | Kwon | G09G 3/36 345/89 |
| 2013/0271512 | A1 * | 10/2013 | Chiu | G09G 3/003 345/691 |

FOREIGN PATENT DOCUMENTS

| | | |
|---|---|---|
| KR | 1020030060462 | 7/2003 |
| KR | 1020030067949 | 8/2003 |
| KR | 1020030093835 | 12/2003 |
| KR | 1020040038411 | 5/2004 |
| KR | 1020070014705 | 2/2007 |

* cited by examiner

*Primary Examiner* — Joseph Haley
*Assistant Examiner* — Emily Frank
(74) *Attorney, Agent, or Firm* — F. Chau & Associates, LLC

(57) ABSTRACT

A display device includes a display unit, a gamma voltage generator, a gamma voltage unit, a data driver, and a timing controller. The display unit includes pixels emitting light according to data signals supplied through data lines. The gamma voltage generator is configured to generate a first set of reference gamma voltages, and to supply the first set of reference gamma voltages to a gamma voltage unit. The gamma voltage unit is configured to generate gamma voltages using the first set of reference gamma voltages and a second set of reference gamma voltages, and to supply the generated gamma voltages to a data driver. The data driver is configured to generate the data signals using the generated gamma voltages, and to supply the generated data signal to the data lines. The timing controller is configured to control the data driver according to an image signal.

19 Claims, 4 Drawing Sheets

GAMMA VOLTAGE SUPPLY DEVICE AND DISPLAY DEVICE USING THE SAME

CROSS-REFERENCE TO RELATED APPLICATION

This application claims priority under 35 U.S.C. §119 to Korean Patent Application No. 10-2013-0083016, filed on Jul. 15. 2013, the disclosure of which is incorporated by reference herein its entirety.

TECHNICAL FIELD

Exemplary embodiments of the present invention relate to a gamma voltage supply device, and more particularly, a gamma voltage supply device and a display device using the gamma voltage supply device.

DISCUSSION OF THE RELATED ART

Among that panel displays, an organic light emitting diode (OLED) display may use an OLED that emits light by recombination of electrons and holes to display an image.

Since the OLED display has a fast response speed, low power consumption, high luminous efficiency, high luminance, and a wide viewing angle, the OLED display may be used for various electronic products such as a portable terminal or a large television.

The OLED display may include a passive matrix type of OLED display (PMOLED) and an active matrix type of OLED display (AMOLED).

In the OLED display, a reference gamma voltage with a constant level may be supplied to a data driver to ensure a stable quality of display.

In this case, the reference gamma voltages may be set according to a plurality of grayscales.

Further, the levels of the reference gamma voltages may be equally spaced.

Accordingly, the data driver may select and supply a reference gamma voltage among the equally spaced reference gamma voltages to a pixel. The reference gamma voltage may correspond to a grayscale of an image signal input from the outside.

Human eyes may be more sensitive when an image of a low grayscale having a low luminance is displayed than when an image of a high grayscale having a high luminance is displayed.

When the levels of the reference gamma voltages are equally spaced and the images of the low grayscales are displayed, the human eyes may easily recognize a deviation in luminance of the images displayed according to the equally spaced reference gamma voltages.

SUMMARY

According to an exemplary embodiment of the present invention, a display device is provided. The display device includes a display unit, a gamma voltage generator, a gamma voltage unit, a data driver, and a timing controller. The display unit includes a plurality of pixels emitting light according to a plurality of data signals supplied through a plurality of data lines. The gamma voltage generator is configured to generate a first set of reference gamma voltages, and to supply the first set of reference gamma voltages to a gamma voltage unit. The gamma voltage unit is configured to generate a plurality of gamma voltages using the first set of reference gamma voltages and a second set of reference gamma voltages, and to supply the generated plurality of gamma voltages to a data driver. The data driver is configured to generate the plurality of data signals using the generated plurality of gamma voltages, and to supply the generated data signal to the data lines. The timing controller is configured to control the data driver according to an image signal. A difference between successive reference gamma voltages of the first set of reference gamma voltages is smaller than a difference between successive reference gamma voltages of the second set of reference gamma voltages.

The display device may further include a voltage divider configured to supply the second set of reference gamma voltages to the gamma voltage unit.

A grayscale displayed according to one of the plurality of gamma voltages generated using the first set of reference gamma voltages may be lower than a grayscale displayed according to a gamma voltage generated using the second set of reference gamma voltages.

The gamma voltage unit may include a resistor string including at least one resistor connected in series.

Voltage levels of the first set of reference gamma voltages may be equally spaced in a first voltage interval.

Voltage levels of the second set of reference gamma voltages may be equally spaced in a second voltage interval.

The second voltage interval may be greater than the first voltage interval.

According to an embodiment of the present invention, a gamma voltage supply device of supplying a gamma voltage to a data driver is provided. The gamma voltage supply device includes a gamma voltage generator and a gamma voltage unit. The gamma voltage generator is configured to generate a first set of reference gamma voltages, and to supply the first set of reference gamma voltages to a gamma voltage unit. The gamma voltage unit is configured to generate a plurality of gamma voltages using the first set of reference gamma voltages and the second set of reference gamma voltages set, and to supply the generated plurality of gamma voltages to the data driver. A difference between successive reference gamma voltages of the first set of reference gamma voltages is smaller than a difference between successive reference gamma voltages of the second set of reference gamma voltages.

According to an embodiment of the present invention, a gamma voltage supply device of supplying a gamma voltage to a data driver is provided. The gamma voltage supply device includes a gamma voltage generator, a voltage divider, and a gamma voltage unit. The gamma voltage generator is configured to generate a first set of reference gammas voltages, and to supply the first set of reference gamma voltages to a gamma voltage unit. The voltage divider is configured to supply a second set of reference gamma voltages to the gamma voltage unit, and supply the second set of reference gamma voltages to a gamma voltage unit. The gamma voltage unit is configured to generate a plurality of gamma voltages using the first set of reference gamma voltages or the second set of reference gamma voltages, and to supply the generated plurality of gamma voltages to the data driver.

A grayscale displayed according to one of the plurality of gamma voltages generated using the first set of reference gamma voltages is lower than a grayscale display according to one of the plurality of gamma voltages generated using the second set of reference gamma voltages.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE EMBODIMENTS

Figure 1:
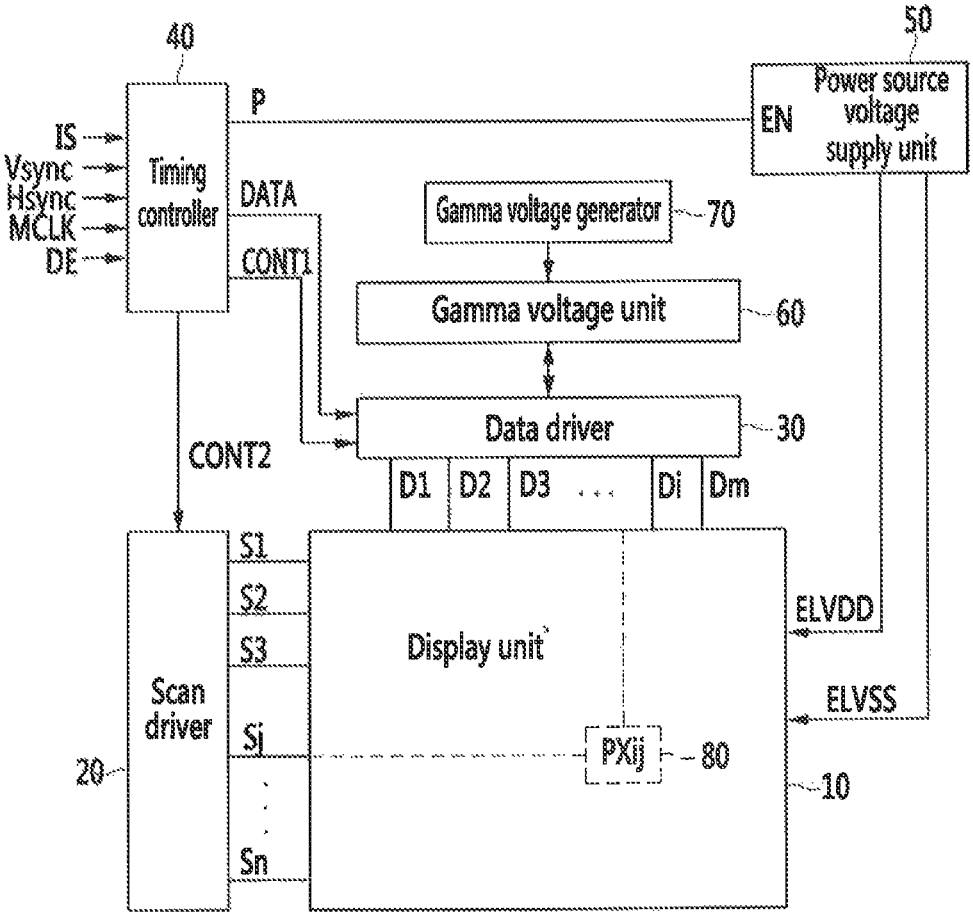
FIG. 1 is a block diagram illustrating a display device according to an exemplary embodiment of the present invention.

FIG. 1 is a block diagram illustrating a display device according to an exemplary embodiment of the present invention.

Referring to FIG. 1, the display device may include a display unit 10 with a plurality of pixels 80, a scan driver 20, a data driver 30, a timing controller 40, a power source voltage supply unit 50, a gamma voltage unit 60, and a gamma voltage generator 70.

The display unit 10 may be a display panel including a plurality of pixels 80. Each of the plurality of pixel may be connected to a corresponding one of a plurality of scan lines S1 to Sn and a corresponding one of a plurality of data lines D1 to Dm.

Each of the plurality of pixels 80 may display an image corresponding to an image data signal.

The plurality of pixels 80 of the display unit 10 are connected to the plurality of scan lines S1 to Sn and the plurality of data lines D1 to Dm to be arranged substantially in a matrix pattern.

The plurality of scan lines S1 to Sn extends substantially in a row direction and is arranged almost in parallel.

The plurality of data lines D1 to Dm extends substantially in a column direction and is arranged almost in parallel.

Each of the plurality of pixels in the display unit 10 may receive a power source voltage, that is, a first driving voltage ELVDD and a second driving voltage ELVSS.

The scan driver 20 may be connected to the display unit 10 through the plurality of scan lines S1 to Sn.

The scan driver 20 may generate a plurality of scan signals capable of activating each of the plurality of pixels 80 of the display unit 10 according to a scan control signal CONT2, and thus, it may transmit the generated plurality of scan signals to corresponding scan lines of the plurality of scan lines S1 to Sn.

The scan control signal CONT2 may be transmitted by the timing controller 40 and used to control the scan driver 20.

The scan control signal CONT2 may include a scan start signal SSP and a clock signal CLK.

The scan start signal SSP may be a signal to generate a first scan signal for displaying an image of one frame.

The clock signal CLK may be a synchronization signal for sequentially applying a scan signal to the plurality of scan lines S1 to Sn.

The data driver 30 may be connected to the plurality of pixels 80 of the display unit 10 through the corresponding plurality of data lines D1 to Dm.

The data driver 30 may receive an image data signal DATA and transmit the image data signal DATA to a corresponding one of the plurality of data lines D1 to Dm according to a data control signal CONT1.

The data control signal CONT1 may be transmitted by the timing controller 40 and used to control the data driver 30.

The data driver 30 may select a gray voltage according to an image data signal DATA and transfer the selected gray voltage to a plurality of data lines D1 to Dm.

The timing controller 40 may receive an image signal IS transferred from an external source and an input control signal for controlling display of the image signal IS.

The image signal IS may include luminance information of the display panel 10. The luminance may include a predetermined number of grayscales (e.g., 1024 ($=2^{10}$), 256 ($=2^{8}$), or 64 ($=2^{6}$)).

The input control signal received by the timing controller 40 may include a vertical synchronization signal Vsync, a horizontal synchronization signal Hsync, a main clock signal MCLK, and a data enable signal DE.

The timing controller 40 may perform an image-process for the input image signal IS based on the input image signal IS and the input control signal, and thus, the image-processed input image signal IS may be suitable for operation conditions of the display unit 10 and the data driver 30.

In detail, the timing controller 40 may generate an image data signal DATA by performing the image processing procedure for the input image signal IS. The image processing procedure may include a gamma correction or an luminance correction for the input image signal IS.

Further, the timing controller 40 may transfer a scan control signal CONT2 for controlling an operation of the scan driver 20 to the scan driver 20.

The timing controller 40 may generate a data control signal CONT1 for controlling an operation of the data driver 30, and transfer the generated data control signal to the data driver 30 together with the image data signal DATA which is processed.

Further, the timing controller 40 may control the driving of the power source voltage supply unit 50.

The power source voltage supply unit 50 may supply a power source voltage for driving the plurality of pixels 80 of the display unit 10.

For example, the timing controller 40 may be connected to a drive terminal EN of the power source voltage supply unit 50. The timing controller 40 may transfer a driving signal P to the power source voltage so that the power source voltage supply unit 50 may be driven.

Next, the power source voltage supply unit 50 may be electrically connected to the plurality of pixels 80 of the display unit 10 through power wires to supply power source voltages to the plurality of pixels 80.

The power source voltage may include a first power source voltage ELVDD at a high level and a second power source voltage ELVSS.

The gamma voltage generator 70 may supply a reference gamma voltage corresponding to a grayscale of the image data signal DATA to the gamma voltage unit 60.

The gamma voltage unit 60 may supply a gamma voltage corresponding to a grayscale of the image data signal DATA to the data driver 30. The gamma voltage may be generated using the reference gamma voltage supplied by the gamma voltage generator 70.

The gamma voltage unit 60 may include a resistor string with a plurality of resistors which are serially arranged.

Configurations of the gamma voltage unit 60 and the gamma voltage generator 70 according to an embodiment of the present invention will be described in detail with reference to FIG. 2.

Figure 2:
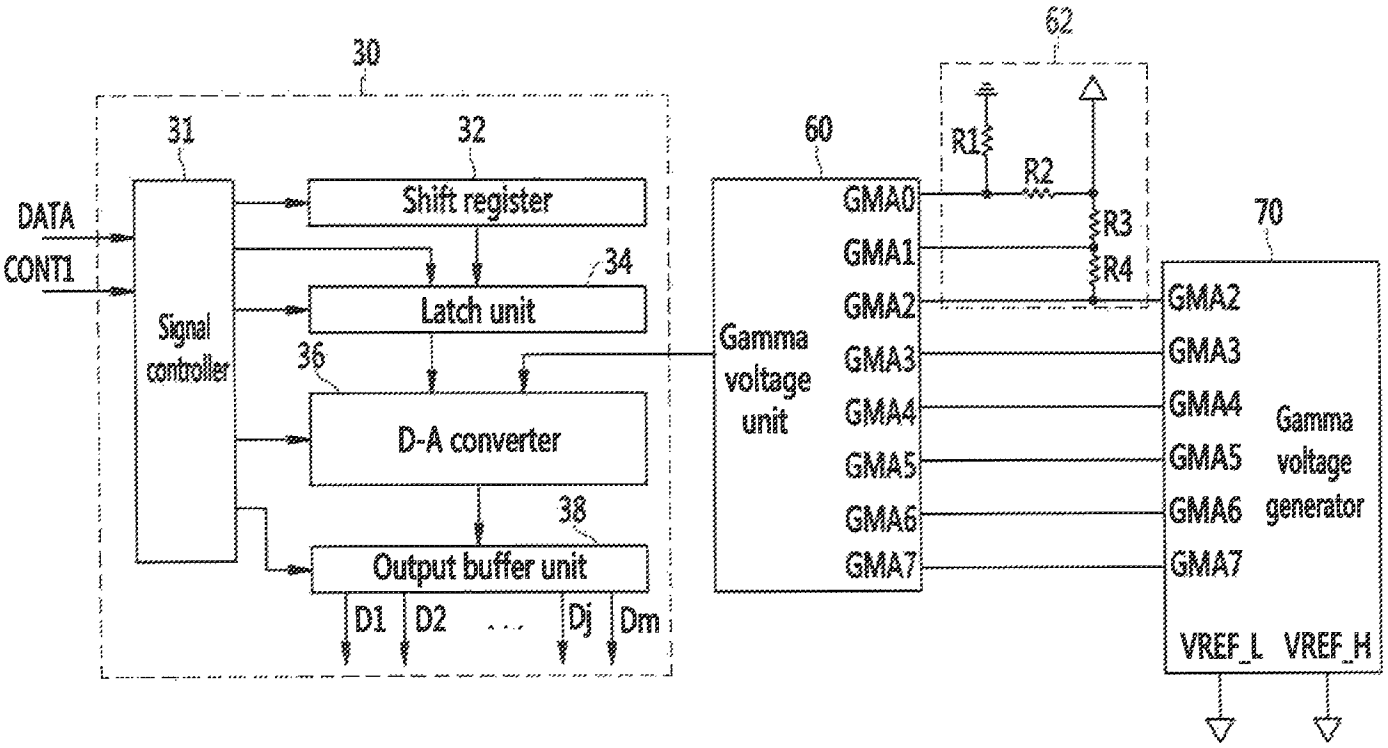
FIG. 2 is a block diagram illustrating an example of a data driver, a gamma voltage unit, and a gamma voltage generator of a display device according to an exemplary embodiment shown in FIG. 1.

FIG. 2 is a block diagram illustrating examples of a data driver 30, a gamma voltage unit 60, and a gamma voltage generator 70 of a display device according to an exemplary embodiment shown in FIG. 1.

Referring to FIG. 2, the data driver 30 may include a signal controller 31, a shift register 32, a latch unit 34, a digital-to-analog converter 36, and an output buffer unit 38.

The gamma voltage generator 70 may generate a plurality of reference gamma voltages, and supply the generated plurality of reference gamma voltages to the gamma voltage unit 60.

The gamma voltage unit 60 may subdivide the plurality of reference gamma voltages generated from the gamma voltage generator 70 using the internal resistor string, and supply a gamma voltage to the digital-to-analog converter 36. The gamma voltage supplied to the digital-to-analog coveter 36 may correspond to a grayscale of the image data signal DATA.

For example, the gamma voltage unit 60 may output 256 different levels of gamma voltages through nodes between serially connected resistors to each other of the internal resistor string to the digital-to-analog converter 36.

The gamma voltage unit 60 may receive a first set of reference gamma voltages from the gamma voltage generator 70.

Further, the gamma voltage unit 60 may receive a second set reference gamma voltages through a voltage division circuit 62 which is separated from the gamma voltage generator 70.

To generate the second set of reference gamma voltages, the voltage division circuit 62 may divide a voltage provided from a voltage source connected to the voltage division circuit 62 according to resistance values of first to fourth resistors R1, R2, R3, and R4.

The gamma voltage unit 60 may use different sets of reference gamma voltages to generate a gamma voltage according to a gray scale of the image data signal DATA. For example, when the gray scale is lower than a predetermined value (hereafter, "low gray scale"), the gamma voltage unit 60 may use the first set of reference gamma voltages to generate the gamma voltage. When the gray scale is higher than a predetermined value (hereafter, "high grayscale"), then the gamma voltage unit 60 may use the second set of reference gamma voltages to generate the gamma voltage.

For example, the gamma voltage unit 60 may output gamma voltages corresponding to 256 grayscales using eight reference gamma voltages.

The gamma voltage generator 70 may supply six reference gamma voltages among the eight reference gamma voltages to the gamma voltage unit 60. The six reference gamma voltages supplied by the gamma voltage generator 70 may be the first set of reference gamma voltages corresponding to the low grayscale.

The voltage division circuit 62 may supply two reference gamma voltages among the eight reference gamma voltages to the gamma voltage unit 60. The two reference gamma voltages supplied by the voltage division circuit 62 may be the second set of reference gamma voltages corresponding to the high grayscale.

However, the number of reference gamma voltages is not limited thereto.

An interval between levels of the first set of reference gamma voltages may be smaller than an interval between levels of the second set of reference gamma voltages.

To supply the first set of reference gamma voltages, a first voltage VREF_L and a second voltage VREF_H are input to the gamma voltage generator 70.

The gamma voltage generator 70 may change the first voltage VREF_L and the second voltage VREF_H to eight reference gamma voltages.

For example, the eight reference gamma voltages may include voltage levels obtained by dividing the interval between the first voltage VREF_L and the second voltage VREF_H.

For example, when the first voltage VREF_L is 3.5 V and the second voltage VREF_H is 5.5 V, eight reference gamma voltages may include voltage levels ranging from 3.5 V to 5.5 V at voltage intervals of about 0.286 V.

The gamma voltage generator 70 may output a reference gamma voltage corresponding to a low grayscale among the eight reference gamma voltages.

The reference gamma voltages supplied from the division circuit 62 may have levels satisfying a gamma curve of the display device.

For example, the two reference gamma voltages of the second set of reference gamma voltages may include a maximum gamma voltage required by the display and another voltage which evenly divides between the maximum gamma voltage and a maximum reference gamma voltage of the first set of reference gamma voltages.

For example, when the maximum gamma voltage is 7 V and the maximum reference gamma voltage of the first set of reference gamma voltages is 4.928 V, the voltage division circuit 62 may output 7 V and about 5.96 V as the two reference gamma voltages to the gamma voltage unit 60.

Accordingly, a voltage interval of the first set of reference gamma voltages (e.g., six reference gamma voltages generated from the gamma voltage generator 70) may be about 0.286 V, and a voltage interval of the second set of reference gamma voltages (e.g., two reference gamma voltages generated from the voltage division circuit 62) may be about 1.036 V.

Accordingly, the gamma voltage unit 60 may subdivide the first set of reference gamma voltages and the second set of reference gamma voltages, and output a gamma voltage according to a grayscale of the image data signal DATA.

The gamma voltage unit 60 may subdivide successive reference gamma voltages of the first set of reference gamma voltages and successive reference gamma voltages of the second set of reference gamma voltages by the same number.

For example, when the first set of reference gamma voltages includes the first reference gamma voltage to the sixth reference gamma voltage and the second set of reference gamma voltages includes the seventh reference gamma voltage and the eighth reference gamma voltage, then the gamma voltage unit 60 may subdivide the successive gamma voltages (e.g., first reference gamma voltage and the second reference gamma voltage) into 32 levels of voltages, and the gamma voltage unit 60 may subdivide the seventh reference gamma voltage and the eighth reference gamma voltage into 32 levels of voltages.

Accordingly, a voltage interval subdividing the first set of reference gamma voltages may be smaller than a voltage interval subdividing the second set of reference gamma voltages. The first set of reference gamma voltages may correspond to a low gray scale of the image data signal DATA and the second set of reference gamma voltages may correspond to a high gray scale of the image data signal DATA.

Next, the signal controller 31 may relay the image data signal DATA and the data control signal CONT1 transmitted from the timing controller, and control output of the relayed control signals to be suitable constituent elements.

The shift register 32 may supply a sequential sampling signal to the latch unit 34. The latch unit 34 may sequentially latch the image data signal DATA by a predetermined size in response to the sampling signal, and simultaneously output the latched signal.

The digital-to-analog converter 36 may convert the latched image data signal DATA through the latch unit 34 into an analog pixel signal using the reference gamma voltages. The converted analog pixel signal may be supplied to the output buffer unit 38. The output buffer unit 38 may output the analog pixel signal to data lines D1 to Dm.

In this manner, the display unit 130 may display a desired image according to the analog pixel signal during one horizontal period of each pixel 80 to which a scan signal is supplied through scan lines S1 to Sn.

Figure 3:
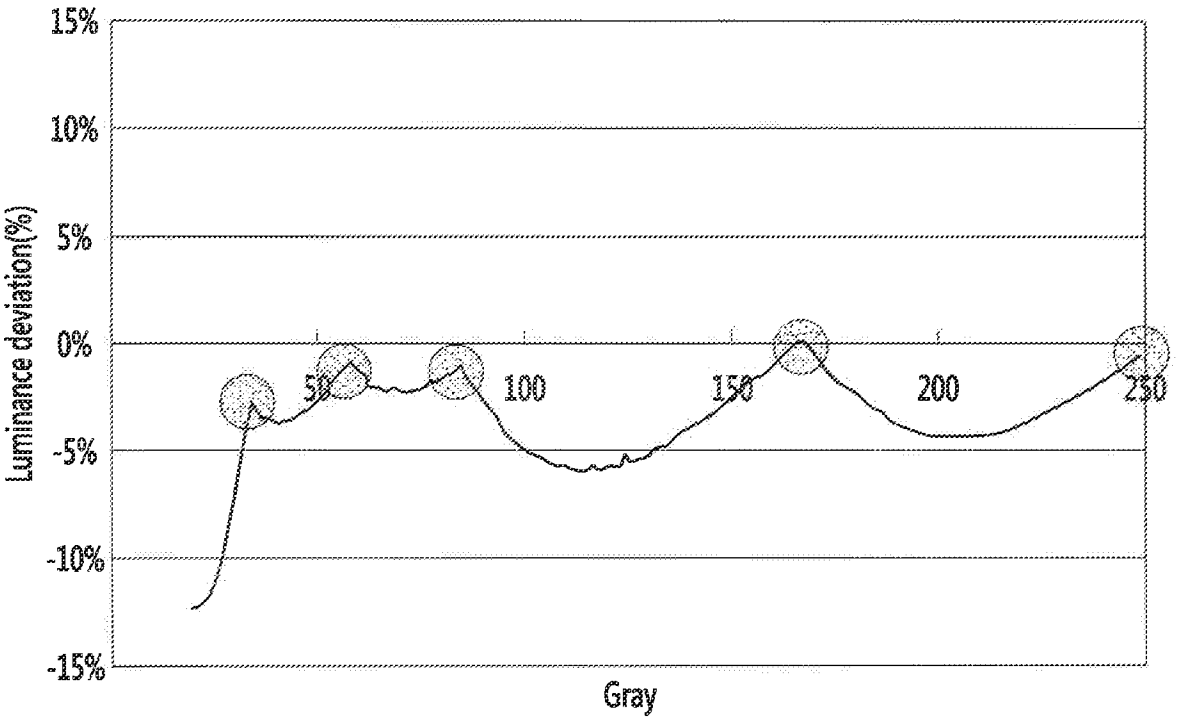
FIG. 3 is a graph illustrating a measured deviation of luminance according to a grayscale of the display device according to an exemplary embodiment of the present invention.
Figure 4:
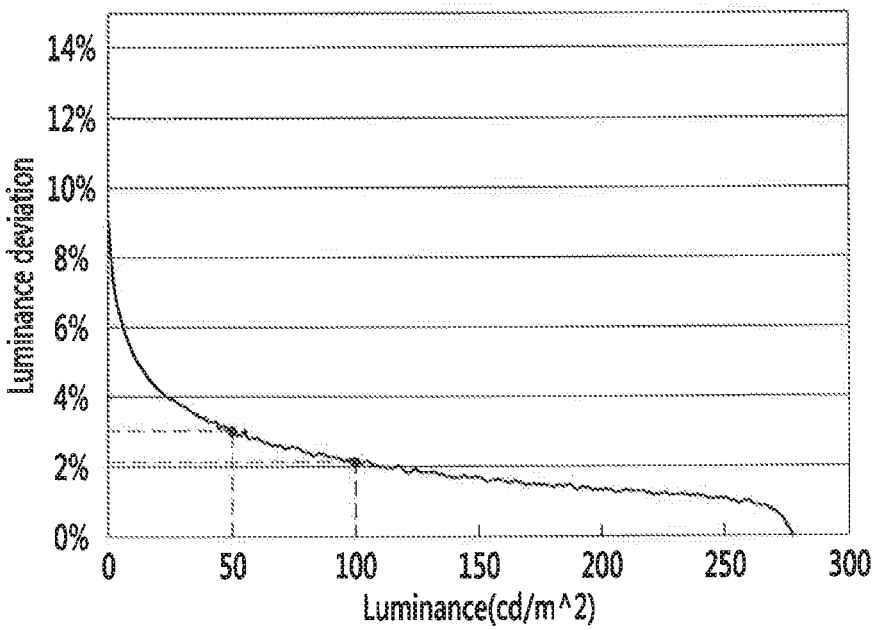
FIG. 4 is a graph illustrating a deviation of luminance of each step in the display device measured as a function of a luminance in a display device according to an exemplary embodiment of the present invention.

FIG. 3 is a graph illustrating a measured deviation of luminance according to a grayscale of an image data signal in the display device according to an exemplary embodiment of the present invention. FIG. 4 is a graph illustrating a deviation of luminance at each step measured as a function of a luminance of an image data signal in the display device according to an exemplary embodiment of the present invention.

Since a voltage interval of the reference gamma voltages corresponding to images of low grayscales is minute, a deviation of luminance in a relatively low grayscale region may be 5% or less.

FIG. 4 shows a deviation of luminance by stages of the luminance is measured according to a grayscale. When the luminance is 100 cd/m$^2$, a deviation of luminance may be about 2%, and when the luminance is 50 cd/m$^2$, a deviation of luminance may be about 3%.

In the gamma voltage supply device and the display device using the gamma voltage supply device according to an exemplary embodiment of the present invention, a deviation of luminance for an image of a low grayscale may be reduced, and the luminance may be minutely controlled by setting an voltage interval of reference gamma voltages corresponding to images of low grayscales to be less than an interval of reference gamma voltages corresponding to images of high grayscale.

While the inventive concept has been particularly shown and described with reference to exemplary embodiments thereof, it will be understood by those of ordinary skill in the art that various variations in form and details may be made therein without departing from the spirit and scope of the inventive concept as defined by the following claims.

What is claimed is:

1. A display device comprising:

a display unit including a plurality of pixels emitting light according to a plurality of data signals supplied through a plurality of data lines;

a gamma voltage generator configured to generate a first set of reference gamma voltages;

a gamma voltage unit configured to generate a plurality of gamma voltages using the first set of reference gamma voltages and a second set of reference gamma voltages;

a data driver configured to generate the plurality of data signals using the generated plurality of gamma voltages; and a timing controller configured to output first and second image data to the data driver according to an image signal, wherein the gamma voltage unit generates a first gamma voltage of the plurality of gamma voltages using the first set of reference gamma voltages when the first image data having a grayscale lower than a predetermined value is input, and generates a second gamma voltage of the plurality of gamma voltages using the second set of reference gamma voltages when the second image data having a grayscale higher than the predetermined value is input, wherein a difference between successive reference gamma voltages of the first set of reference gamma voltages is smaller than a difference between successive reference gamma voltages of the second set of reference gamma voltages.

2. The display device of claim 1, further comprising a voltage divider configured to generate the second set of reference gamma voltages.

3. The display device of claim 1, wherein a grayscale displayed according to one of the plurality of gamma voltages generated using the first set of reference gamma voltages is lower than a grayscale display according to one of the plurality of gamma voltages generated using the second set of reference gamma voltages.

4. The display device of claim 1, wherein the gamma voltage unit comprises a resistor string including at least one resistor connected in series.

5. The display device of claim 1, wherein voltage levels of the first set of reference gamma voltages are equally spaced in a first voltage interval.

6. The display device of claim 5, wherein voltage levels of the second set of reference gamma voltages are equally spaced in a second voltage interval.

7. The display device of claim 6, wherein the second voltage interval is greater than the first voltage interval.

8. A gamma voltage supply device comprising:

a gamma voltage generator configured to generate a first set of reference gamma voltages; and a gamma voltage unit configured to generate a plurality of gamma voltages using the first set of reference gamma voltages and a second set of reference gamma voltages, wherein the gamma voltage unit generates a first gamma voltage of the plurality of gamma voltages using the first set of reference gamma voltages when input image data has a grayscale lower than a predetermined value, and generates a second gamma voltage of the plurality of gamma voltages using the second set of reference gamma voltages when the input image data has a grayscale higher than the predetermined value, wherein a difference between successive reference gamma voltages of the first set of reference gamma voltage is smaller than a difference between successive reference gamma voltages of the second set of reference gamma voltages.

9. The gamma voltage supply device of claim 8, further comprising a voltage divider configured to generate the second set of reference gamma voltages.

10. The gamma voltage supply device of claim 8, wherein a grayscale displayed according to one of the plurality of gamma voltages generated using the first set of reference gamma voltages is lower than a grayscale displayed according to one of the plurality of gamma voltages generated using the second set of reference gamma voltages.

11. The gamma voltage supply device of claim 8, wherein the gamma voltage unit comprises a resistor string including at least one resistor connected in series.

12. The gamma voltage supply device of claim 8, wherein voltage levels of the first set of reference gamma voltages are equally spaced in a first voltage interval.

13. The gamma voltage supply device of claim 12, wherein voltage levels of the second set of reference gamma voltages are equally spaced in a second voltage interval.

14. The gamma voltage supply device of claim 8, wherein the second voltage interval is greater than the first voltage interval.

15. A gamma voltage supply device comprising:

a gamma voltage generator configured to generate a first set of reference gamma voltages;

a voltage divider configured to generate a second set of reference gamma voltages; and a gamma voltage unit configured to generate a plurality of gamma voltages using the first set of reference gamma voltages and the second set of reference gamma voltages, wherein the gamma voltage unit generates a first gamma voltage of the plurality of gamma voltages using the first set of reference gamma voltages when input image data has a grayscale lower than a predetermined value, and generates a second gamma voltage of the plurality of gamma voltages using the second set of reference gamma voltages when the input image data has a grayscale higher than the predetermined value, wherein a difference between successive reference gamma voltages of the first set of reference gamma voltage is smaller than a difference between successive reference gamma voltages of the second set of reference gamma voltages.

16. The display device of claim 15, wherein the gamma voltage unit comprises a resistor string including at least one resistor connected in series.

17. The display device of claim 15, wherein voltage levels of the first set of reference gamma voltages are equally spaced in a first voltage interval.

18. The display device of claim 17, wherein voltage levels of the second set of reference gamma voltages are equally spaced in a second voltage interval.

19. The display device of claim 18, wherein the second voltage interval is greater than the first voltage interval.

* * * * *